US005377464A

United States Patent [19]

Mott et al.

[11] Patent Number: 5,377,464

[45] Date of Patent: Jan. 3, 1995

[54] RETRAINER STRIP FOR WINDOW FLASHING

[75] Inventors: Richard A. Mott, Alexandria; Richard S. Hite, Sylvania, both of Ohio

[73] Assignee: Owens-Corning Fiberglas Technology Inc., Summit, Ill.

[21] Appl. No.: 741,709

[22] Filed: Aug. 7, 1991

[51] Int. Cl.[6] ..... E06B 1/04; E04B 1/62

[52] U.S. Cl. ..... 52/213; 52/396.04

[58] Field of Search ..... 52/211, 213, 396, 403, 52/396.04; 49/488, 485; 404/64, 69

[56] References Cited

U.S. PATENT DOCUMENTS

| | | | |
|---|---|---|---|
| 2,840,202 | 6/1958 | Hehr . | |
| 3,103,710 | 9/1963 | Fredricksen | 52/211 |
| 3,276,167 | 10/1966 | Bus et al. | 49/485 |
| 3,448,543 | 6/1969 | Multer | 49/488 |
| 3,473,278 | 10/1969 | Gossen | 52/287 |
| 3,694,985 | 10/1972 | Spaiches | 52/403 |
| 4,006,569 | 2/1977 | Kain | 52/400 |
| 4,193,238 | 3/1980 | Chalmers et al. | 52/211 |
| 4,226,066 | 10/1980 | Persson | 52/211 |
| 4,423,575 | 1/1984 | Lagergren et al. | 52/211 |
| 4,510,715 | 4/1985 | Giguere | 49/488 |
| 4,821,472 | 4/1989 | Tix | 52/213 |
| 4,909,005 | 3/1990 | Adams | 52/215 |
| 4,999,957 | 3/1991 | Kessler | 52/213 |

FOREIGN PATENT DOCUMENTS

| | | | |
|---|---|---|---|
| 2627800 | 9/1989 | France | 52/400 |
| 238427 | 6/1964 | Germany | 52/400 |
| 1467380 | 3/1977 | United Kingdom | 52/403 |

*Primary Examiner*—James L. Ridgill, Jr.
*Attorney, Agent, or Firm*—Ted C. Gillespie

[57] ABSTRACT

A retainer strip for a window flashing used to weatherproof the installation of a window comprises a window grip leg for holding the retainer strip in a kerf in the window frame, and a flashing grip leg adapted to be mounted parallel to the side of the window frame for retaining the flashing in the space between the window grip leg and the side of the window frame.

20 Claims, 1 Drawing Sheet

RETRAINER STRIP FOR WINDOW FLASHING

TECHNICAL FIELD

This invention pertains to equipment for the installation of windows in a building. More particularly, this invention relates to means for enabling the securement of architectural flashing around a newly installed window.

BACKGROUND ART

When windows are installed in buildings, such as residential dwellings, they are installed in window openings. Replacement windows, as opposed to new residential windows, are usually installed in existing window openings. After the replacement window is installed, prepainted aluminum flashing is used to cover the gap between the new window and the existing siding, brick, or other exterior wall surface of the window opening.

One of the problems with the installation of replacement windows is that the cover or flashing for the opening or gap between the new window frame and the existing building wall needs to be secured or fixed in place, and in a manner which will prevent wind or moisture from entering the building. Further, the flashing must be attached in an aesthetically pleasing manner. Typical means for fastening the window flashing includes nailing, bending, and gluing the flashing in place. Nailing is often difficult because the wood surrounding the window opening may be old and rotten. Another method commonly used is merely caulking the flashing all the way around the perimeter of the window for a wind and water-tight joint. This old method of caulking can degrade after a period of weathering, resulting in air and water leaks into the building. It would be extremely desirable to provide an improved means for retaining the window flashing, particularly if such a method resulted in an easier installation method than methods heretofore employed.

DISCLOSURE OF THE INVENTION

There has now been developed a means for readily attaching the flashing to the window without the need for nails, screws, adhesives, or other fasteners. This invention involves the use of a retainer strip which has two legs, one leg attaching itself to a kerfed portion of the window frame, and a longer leg which extends parallel to the side of the window frame and defines an opening for retaining the window flashing in place.

According to this invention there is provided a retainer for a window flashing used to weatherproof the installation of a window, the retainer strip comprising a window grip leg for retaining the retainer strip in a kerf in the window frame, and a flashing grip leg adapted to be mounted parallel to the side of the window frame for retaining the flashing in the space between the window grip leg and the side of the window frame. Preferably, the window grip leg also has one or more of the gripping members.

In a specific embodiment of the invention, the gripping members are unidirectional, i.e. the window grip leg is easily pushed into the kerf, but not easily removed, and the flashing is easily pushed into the opening defined by the retainer strip, but the flashing is not easily removed.

In another specific embodiment of the invention, the gripping members comprise flexible flanges.

In yet another embodiment of the invention, the flanges are mounted at an angle of less than 90° to the window grip leg and flashing grip leg respectively.

In a specific embodiment of the invention, there is at least one gripping member on each side of the window grip leg.

In yet another embodiment of the invention, the gripping members are comprised of flexible polyvinylchloride ("PVC").

The use of the invention reduces the amount of labor and provides a joint between the flashing and the window which has a pleasing appearance.

BEST MODE OF CARRYING OUT THE INVENTION

Figure 1:
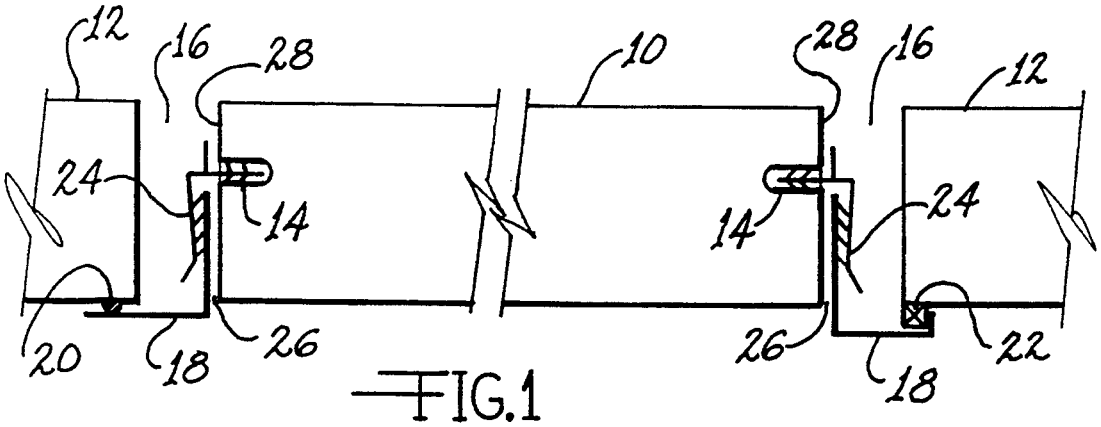
FIG. 1 is a schematic plan view of a window frame and window opening illustrating the retainer strip of the invention.

As shown in FIG. 1, window frame 10 is positioned in the opening defined by the portions of the building wall 12. The window frame can be any suitable window frame, particularly a retrofit window frame for use in replacing the window in an existing opening. The window frame is provided with an elongated slot or kerf 14 which extends around all four sides of the window frame.

Between the window frame and the building wall is a slight gap 16, which is shown exaggerated in FIG. 1. In order to prevent moisture and wind from entering the dwelling through the gap, flashing 18 is positioned across the face of the gap on the exterior side of the building. The flashing can be any suitable flashing, such as painted aluminum flashing. Typically, such flashing is fabricated in the field to fit the required dimensions of the window opening. Several methods are commonly employed for attaching the flashing to the building wall. As shown, the flashing can be laid flat against the building wall and attached with an adhesive or caulking, such as caulk bead 20. Alternatively, the flashing can be nailed or fastened to some member of the building wall, such as molding strip 22.

The end of the flashing which is to be attached to the window frame is held in place by retainer strip 24. The retainer strip defines an opening 26 between the retainer strip and the side 28 of the window frame.

Figure 2:
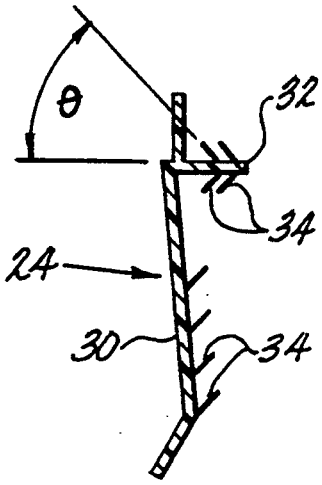
FIG. 2 is a sectional plan view of the retainer strip of the invention.

As shown in FIG. 2, the retainer strip is comprised of flashing grip leg 30 and window grip leg 32. Each of the legs has one or more gripping members, such as flexible flanges 34. Preferably, the two legs are made of a rigid plastic material, such as a rigid PVC. The gripping members are preferably flexible, such as a flexible PVC. Other materials can be used.

As shown, the flexible flanges are oriented in a backwards or unidirectional orientation. For the window grip legs, this means that the flexible flanges will prevent the window grip leg from being removed or pulled from the kerf in the window frame. For the flashing grip leg this means that the flashing can be rather easily inserted into the opening 26, but the orientation of the flexible flanges prevents easy removal of a flashing from the opening. As shown, the flexible flanges are mounted at an angle $\theta$ of less than 90° to the window grip leg and flashing grip leg, respectively.

It is to be understood that other gripping members, such as hooks or other high friction surfaces, could be used on the flashing grip leg and/or the window grip leg.

It will be evident from the foregoing that various modifications can be made to this invention. Such, however, are considered as being within the scope of the invention.

INDUSTRIAL APPLICABILITY

This invention will be found to be useful in the installation of retrofit windows in residential buildings.

We claim:

1. A retainer strip for a window flashing used to weatherproof the installation of a window, the retainer strip comprising a window grip leg for retaining the retainer strip in a kerf in the window frame, and a flashing grip leg adapted to be mounted parallel to the side of the window frame for retaining the flashing in the space between the flashing grip leg and the side of the window frame.

2. A retainer strip for a window flashing used to weatherproof the installation of a window, the retainer strip comprising a window grip leg for retaining the retainer strip in a kerf in the window frame, and a flashing grip leg adapted to be mounted parallel to the side of the window frame, the flashing grip leg having one or more gripping members for retaining the flashing in the space between the flashing grip leg and the side of the window frame.

3. The retainer strip of claim 2 in which the gripping members are unidirectional.

4. The retainer strip of claim 3 in which the gripping members comprise flexible flanges.

5. The retainer strip of claim 4 in which the flanges are mounted at an angle of less than 90° to the window grip leg and flashing grip leg, respectively.

6. The retainer strip of claim 5 in which there is at least one gripping member on each side of the window grip leg.

7. The retainer strip of claim 6 in which the gripping members are comprised of flexible PVC.

8. A retainer strip for a window flashing used to weatherproof the installation of a window, the retainer strip comprising a window grip leg having one or more gripping members for retaining the window grip leg in a kerf in the window frame, and a flashing grip leg adapted to be mounted parallel to the side of the window frame, the flashing grip leg having one or more gripping members for retaining the flashing in the space between the flashing grip leg and the side of the window frame.

9. The retainer strip of claim 8 in which the gripping members are unidirectional.

10. The retainer strip of claim 9 in which the gripping members comprise flexible flanges.

11. The retainer strip of claim 10 in which the flanges are mounted at an angle of less than 90° to the window grip leg and flashing grip leg, respectively.

12. The retainer strip of claim 11 in which there is at least one gripping member on each side of the window grip leg.

13. The retainer strip of claim 12 in which the gripping members are comprised of flexible PVC.

14. In combination, a window frame having a kerf around its periphery, a flashing used to weatherproof the window, and a retainer strip for holding the flashing in place, the retainer strip comprising a window grip leg for retaining the retainer strip in the kerf, and a flashing grip leg mounted parallel to the side of the window frame so that the flashing grip leg and the side of the window define an opening for retaining the flashing in the space between the flashing grip leg and the side of the window frame.

15. The combination of claim 14 in which the flashing grip leg has one or more gripping members for retaining the flashing in the space between the flashing grip leg and the side of the window frame.

16. The combination of claim 15 in which the gripping members are unidirectional.

17. The combination of claim 16 in which the gripping members comprise flexible flanges.

18. The combination of claim 17 in which the flanges are mounted at an angle of less than 90° to the window grip leg and flashing grip leg, respectively.

19. The combination of claim 18 in which there is at least one gripping member on each side of the window grip leg.

20. The combination of claim 19 in which the gripping members are comprised of flexible PVC.

* * * * *